United States Patent [19]

Farnia

[11] 4,029,451

[45] June 14, 1977

[54] GAS BURNING APPARATUS

[75] Inventor: Ken Farnia, East Lansing, Mich.

[73] Assignee: A. O. Smith Corporation, Milwaukee, Wis.

[22] Filed: Feb. 3, 1975

[21] Appl. No.: 546,687

[52] U.S. Cl. ..... 126/361; 126/350 R; 431/328

[51] Int. Cl.[2] ..... F24H 1/00

[58] Field of Search ..... 431/328, 329, 346, 179; 126/361, 362, 350 R, 351, 92 B; 239/553, 557, 559, 567

[56] References Cited

UNITED STATES PATENTS

| | | | |
|---|---|---|---|
| 2,980,104 | 4/1961 | Patrick et al. | 431/328 |
| 3,111,942 | 11/1963 | Miller | 126/362 |
| 3,199,568 | 8/1965 | Baumanns et al. | 126/92 B |
| 3,265,057 | 8/1966 | Horne | 126/92 B |
| 3,515,123 | 6/1970 | Duncan | 126/362 |
| 3,809,061 | 5/1974 | Gerstmann | 126/350 R |
| 3,857,670 | 12/1974 | Karlovetz et al. | 431/329 |
| 3,936,003 | 2/1976 | Hapgood et al. | 239/557 |
| 3,941,116 | 3/1976 | Placek | 431/329 |

*Primary Examiner*—Carroll B. Dority, Jr.
*Attorney, Agent, or Firm*—Andrus, Sceales, Starke & Sawall

[57] ABSTRACT

A liquid conducting heat exchanger is mounted above a combustion zone burning combustible gas supplied by a fan through a combustible gas and air mixing chamber and a plurality of separate burner units spaced adjacent to the combustion zone. Each burner unit is specially designed to provide a gas conducting channel of diminishing cross-sectional area which conducts gas from the mixing chamber to a perforated screen so that gas is supplied to the combustion zone at a velocity greater than the rate of burning by the flame. Each perforated screen provides a convex surface facing the combustion zone while a first screen edge is movably retained within a recess for permitting thermal screen expansion and contraction while the remaining screen side edges are connected to a housing by a gas impervious seal. Each burner unit includes an outwardly extending lip which provides a removably sealing connection with the mixing chamber housing.

14 Claims, 10 Drawing Figures

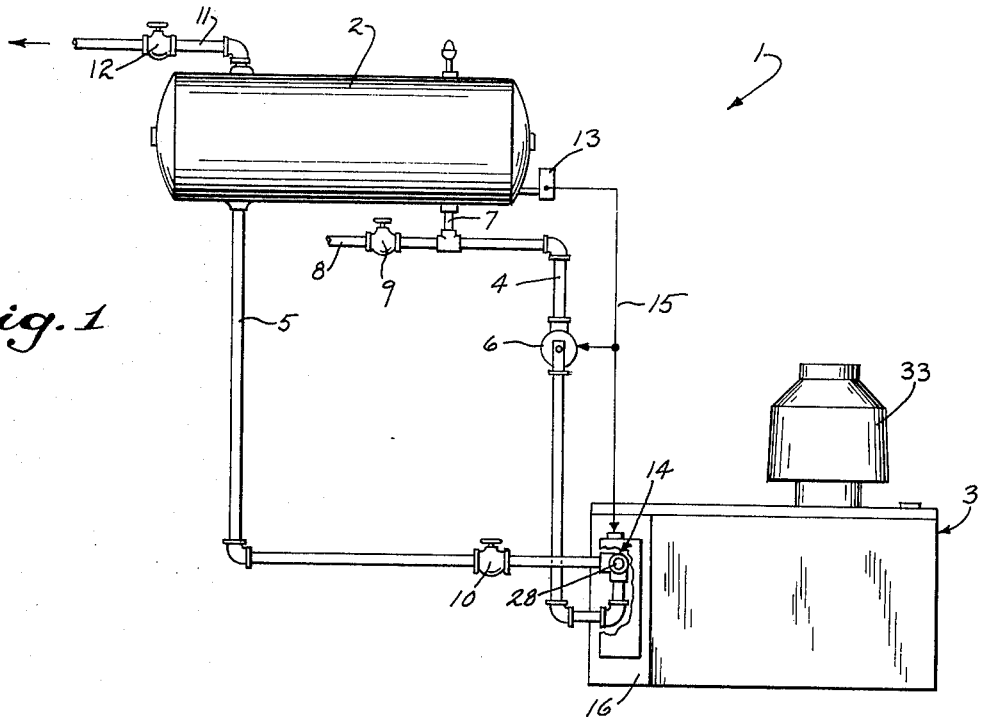
Fig. 1
Fig. 2
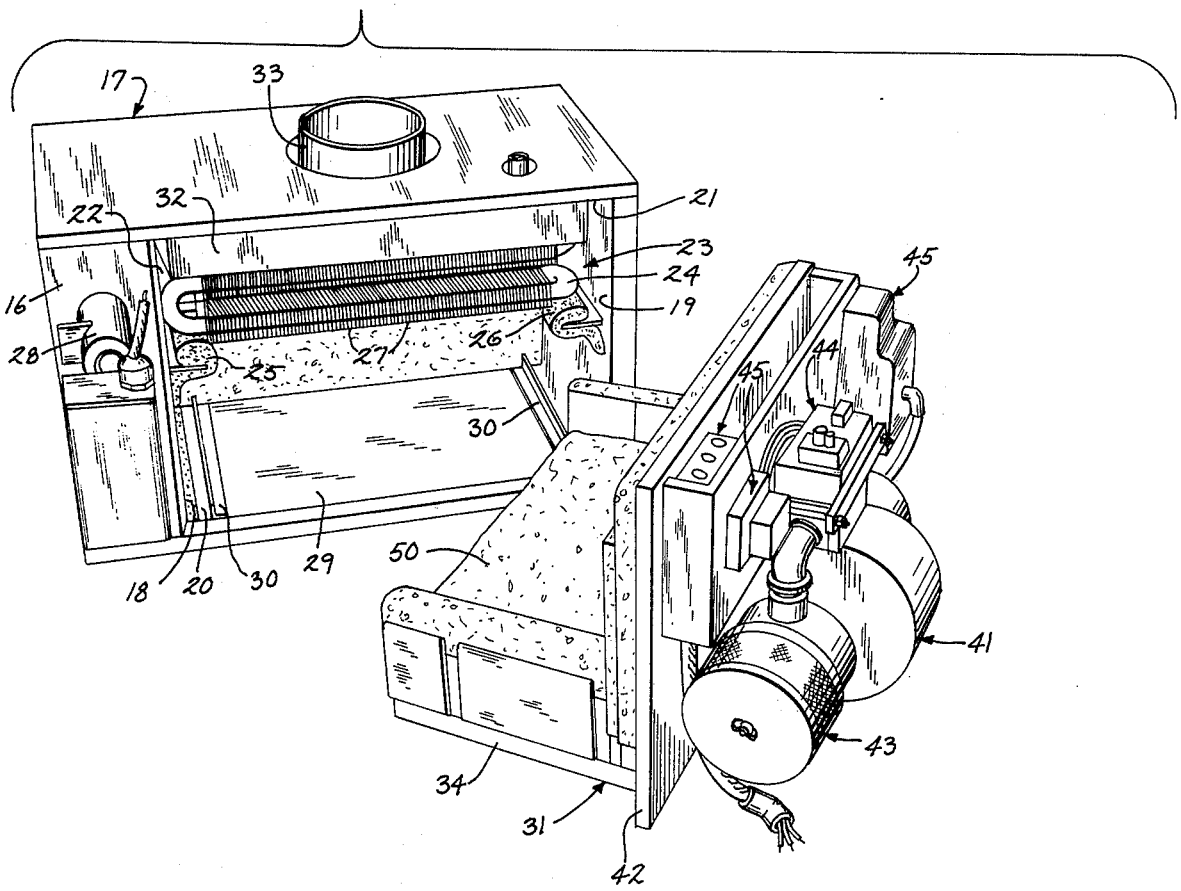

GAS BURNING APPARATUS

BACKGROUND OF THE INVENTION

This invention relates to a gas burning apparatus which conducts gas to a combustion zone in a highly efficient and desirable manner.

Gas burners have been employed for a variety of applications including the heating of water and other liquids for various industrial applications as well as home uses, i.e. wherein water is heated for washing, bathing and other purposes. Many gas burners have been mounted below large liquid containing tanks while other structures have placed gas burners below water conducting heating coils for providing, in both instances, a heat exchanging operation. In such structures, radiant and convection heat provided by the burning mixture of gas and air increases the temperature of the structure containing the liquid thereby increasing the liquid temperature which, in turn, may be pumped or otherwise transferred for storage in containers or for direct use.

Some burners have employed an annularly shaped tubular ring having a plurality of annularly spaced openings for conducting gas and possibly pre-mixed air to the combustion zone generally spaced above the ring.

Other burners have employed a large continuous screen such as the circumferentially shaped screen employed in the U.S. Pat. No. 1,247,740 to Sutton. A continuous large type screen may experience hot spots whenever there is a non-uniform or uneven velocity of the gas flowing through the screen resulting in breaks within the screening material. The cracks further unbalance gas flow which increases the danger of flashback through the cracks into the gas conducting channel whenever the gas velocity is less than the burning rate of the flame. This occurs at the beginning and end of each normal cycle firing and might possibly damage the gas distributor and particularly further damage the screen.

Where a gas burner is intermittently lighted and cooled in a cyclic manner as in many common water heating systems, a rigidly retained perforated screen has been found to readily buckle or wrinkle due to the resulting cyclic expansion and contraction thereof. Such screen distortion due to cyclic expansion and contraction increases the likelihood of cracks developing due to metal fatigue.

Many prior burning units have required a relatively large size screen and combustion chamber in order to develop the necessary heat energy for adequately heating the liquid where demand requirements for the heated liquid are quite large. Such a large screen has been found to readily warp particularly where cyclic gas burning sequences have been required.

Many burners have employed a large gas supplying continuous screen which is also associated with a large gas conducting channel or chamber which has sometimes produced sound resonance in response to the gas flame thereby providing an undesirable audio sound which is highly distracting and renders such a unit commercially undesirable.

SUMMARY OF THE INVENTION

This invention relates to a gas burning apparatus wherein a gas is supplied to a combustion zone for burning.

A burner unit has been specially designed to increase the velocity of combustible gas and air to the combustion zone so as to be greater than the rate of burning of the flame to avoid flashbacks which might otherwise damage or destroy the burner unit. The use of such a specially designed burner unit has been found to provide a versatile, high energy burner construction wherein a number of such units can be placed about the combustion zone to provide a compact apparatus for efficient high energy conversion. The increase in gas flow velocity is provided by a specially constructed channel which includes a first cross-sectional area located adjacent to an inlet opening and a second cross-sectional area less than the first area located adjacent to an outlet opening communicating with the combustion zone. Pre-mixed combustible gas and air is efficiently supplied to the burner unit channel to provide a high velocity output to the combustion zone for exceptional high energy heating.

In one aspect of the invention, the burning apparatus provides a perforated screen having a convex surface facing the combustion zone for intermittently supplying gas to the combustion zone for intermittent burning therein. It has been found that the convex configuration of the screen tends to reduce or eliminate buckling and wrinkling of the outer surface facing the combustion zone which frequently is encountered when employing flat or circular screens in intermittent and cyclic burner sequences.

In another aspect of the invention, an edge portion of the perforated screen is movably retained within a recess provided by a housing which permits thermal expansion and contraction of the screen when used in an intermittent burning sequence. It has been found that the convex screen surface and the movable connection of a screen side edge has produced superior results, both individually and in combination, by increasing the screen life expectancy.

In a desirable construction of the invention, a burner unit is specially designed to provide a first front panel which includes an inlet opening communicating with a gas supply channel. A connector member is connected to the first front panel and includes a portion spaced from the first front panel to provide a recess therebetween while a second front panel includes a perforated screen which is movably retained within the recess. A back panel is connected to the first and second front panels to provide a unit channel which communicates with the inlet opening and the perforated screen to conduct gas from the gas supply channel to the combustion zone in a highly efficient and desirable manner.

The connector member provides a highly desirable dual functioning purpose by providing a second portion which extends into the supply channel and provides a sealing connection with the housing. In a preferred construction, the second portion of the connector member includes an outwardly extending lip which passes through the inlet opening of the first panel and into the gas supply panel thereby establishing a unique sealing connection.

The back panel is specially constructed to provide a first portion which is spaced from the first front panel by a first predetermined distance and a second portion which is spaced from the second front panel by a second predetermined distance less than the first distance so that the unit gas conducting channel decreases in area and operatively increases the gas velocity therethrough to greatly reduce the possibility of flashbacks occurring which might otherwise destroy or damage a gas distributor unit.

The preforated screen in a desired construction provides a first edge portion which is movably retained within the specially constructed recess formed between the first front panel and the connector member and also provides a second edge portion which is fixedly connected with a gas impervious seal to the back panel. Such a seal is provided by a U-shaped member engaging the second edge portion of the screen and is sealingly connected to the back panel by a weld.

The convex shaped perforated screen has been found to perform exceptionally well when employing approximately 300 openings per square inch with each opening having a diameter of approximately twenty seven thousandths of an inch thereby providing a combined screen open area of approximately 17 percent.

The spaced employment of a plurality of separate burner units has been found to be extremely efficient and desirable for operation with a heat exchanger in a liquid conducting system. In such a construction, a plurality of the spaced burner units are removably connected to openings provided by a mixing chamber receiving pre-mixed combustible gas and air under a predetermined pressure such as supplied by a fan. Such an arrangement permits the plurality of convex shaped screens to be spaced about a relatively small combustion zone located immediately adjacent to a liquid conduit forming a part of the heat exchanger which conducts cold liquid from an inlet and supplies hot liquid to an outlet, such as in a water heating system.

The invention thus provides a gas burner construction in which a number of the specially constructed gas distributing units can be variably and removably arranged to define a compact combustion zone for providing an extremely efficient, high energy conversion. It has been found that the use of a number of smaller gas distributing screens in place of a large screen has greatly reduced the problems incident to rapid screen failures thereby prolonging the life of the burning unit.

BRIEF DESCRIPTION OF THE DRAWINGS

The drawings furnished herewith illustrate the best mode presently contemplated by the inventor and clearly disclose the above advantages and features as well as others which will be readily understood from the detailed description thereof.

In the drawings:

FIG. 1 is a diagrammatic illustration showing a circulating liquid heating system employing the gas burning apparatus of the invention;

FIG. 2 is an elevated perspective view of the gas burning apparatus of FIG. 1 with the burner sub-assembly and the heat exchanger sub-assembly separated and the draft hood and control cover removed for viewing and the elements therein;

DESCRIPTION OF THE PREFERRED ILLUSTRATED EMBODIMENT

Figure 3:
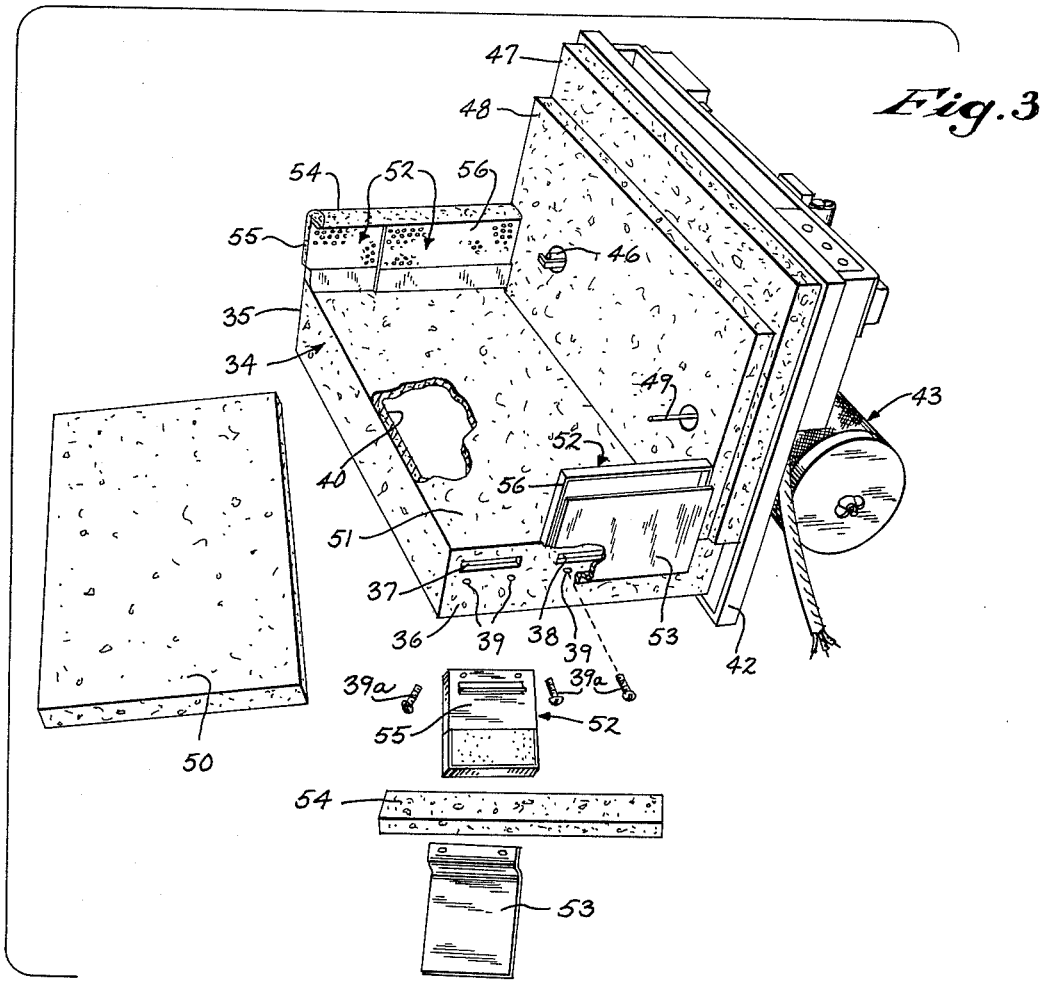
FIG. 3 is an elevated perspective view of the burner sub-assembly of FIG. 2 with a burner unit and other adjacent elements separated.

Referring to the drawings and particularly FIG. 1, the embodiment of the invention is described in connection with a hot water heating system 1 employing a hot water storage tank 2 interconnected to a gas fired heating unit 3 through a pair of circulating lines 4 and 5. A pump 6 is connected within circulating line 4 and supplies cold water to the heating unit 3 from the storage tank 2 through a conduit 7 and from a cold water conduit 8 through a gate valve 9. The heated fluid is supplied to the storage tank 2 through a gate valve 10 and circulating conduit 5 by operation of the pump 6 while hot water is supplied from the storage container 2 for external usage through a conduit 11 and a gate valve 12. A thermostat unit 13 is provided in the lower portion of the tank 2 to sense the temperature of the stored water for controlling a temperature control unit 14 at the heating unit 3 and the pump 6 through an interconnected electrical circuit 15. One such operating control is described in U.S. Pat. No. 3,515,123, issued to A. N. Duncan on June 2, 1970, and assigned to a common assignee herewith.

The temperature control unit 14 is connected to a housing 16, both forming a part of a heat exchanger sub-assembly 17. The housing 16 includes a pair of spaced, oppositely disposed side walls 18 and 19 which are joined by a bottom panel 20, an upper panel 21 and a rear panel 22 thereby forming a chamber 23.

A continuous fluid conducting tubing 24 is mounted upon insulated brackets 25 and 26 mounted on the side walls 18 and 19, respectively. The continuous tubing 24 provides a plurality of spaced heat conducting fins 27 while the opposite ends (not shown) of the tubing 24 are coupled respectively to the circulating conduits 4 and 5 through a fluid connector 28.

A mounting panel 29 is located on the bottom wall 20 and includes a pair of guide flanges 30 for removably retaining a burner sub-assembly 31. A collector 32 is mounted to the upper wall 21 and functions with a baffle (not shown) to conduct waste gases and the like to a draft hood 33.

The burner sub-assembly 31 includes a hollow base 34 removably retained by the guide channels 30 of the heat exchanger sub-assembly 17. The base member 34 includes a pair of spaced, oppositely disposed side walls 35 and 36 each including a first elongated slot 37 and a second elongated slot 38 while two or more bolt receiving openings 39 are spaced below and adjacent to each of the slots 37 and 38.

An enclosed internal chamber 40 within the base member 34 communicates with the four slots 37 and 38 and further communicates with a combination fan and air-gas mixer 41 mounted to an upstanding panel 42. The fan and mixer unit 41 receives air through an air filter 43 and receives combustible gas from a gas valve 44 connected to a gas source (not shown). The operating control for the gas valve 44 and the fan-mixer unit 41 is provided by an electrical control unit 45 coupled to the temperature control unit 14 and which also selectively operates an ignition electrode 46 mounted to the panel 42 and protruding through a pair of insulating sheets 47 and 48. A flame sensing rod 49 is also mounted to the panel 42 and protrudes through the insulating sheets 47 and 48 for detecting the absence of flame to provide a safety cut-off sequence well known in the art. Another sheet of insulation 50 is removably mounted upon an upper surface 51 of the base member 34.

A plurality of burner units 52 are removably mounted to the side walls 35 and 36 along with associated heat shields 53 by bolts or studs 39*a* which have external threads removably engaging internal threads provided by the openings 39 while strips of insulation 54 are removably mounted to rest upon the units 52 and shields 53. Each side wall may removably retain any number of burner units with the walls 35 and 36 each having a burner unit 55 associated with the slot 37 and a burner unit 56 associated with the slot 38.

Figure 8:
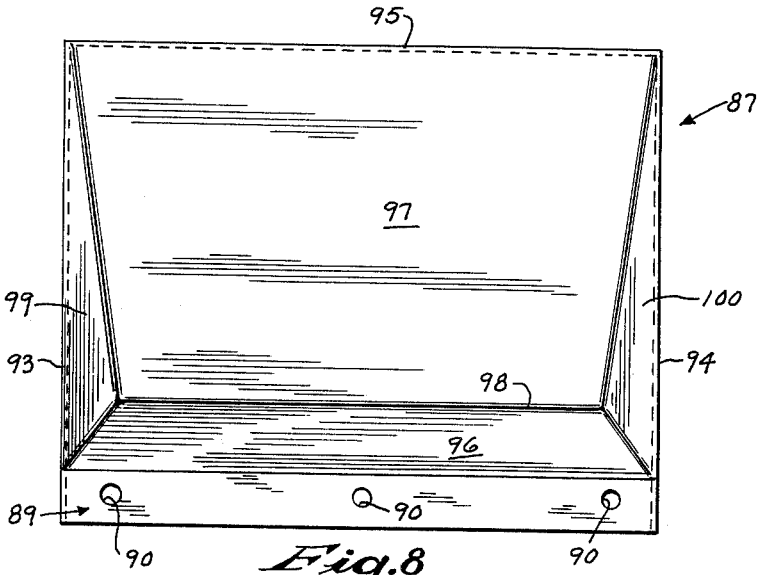
FIG. 8 is a front elevational view of a rear panel employed in the burner unit of FIGS. 4–6.
Figure 9:
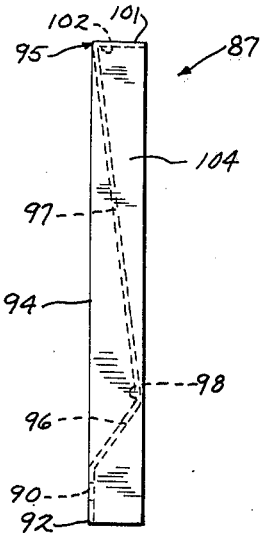
FIG. 9 is a side elevational view of the rear panel of FIG. 8.
Figure 10:
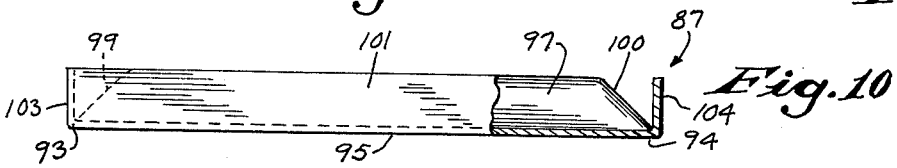
FIG. 10 is a plan view of the rear panel of FIG. 8.
Figures 4, 5, 6, 7:
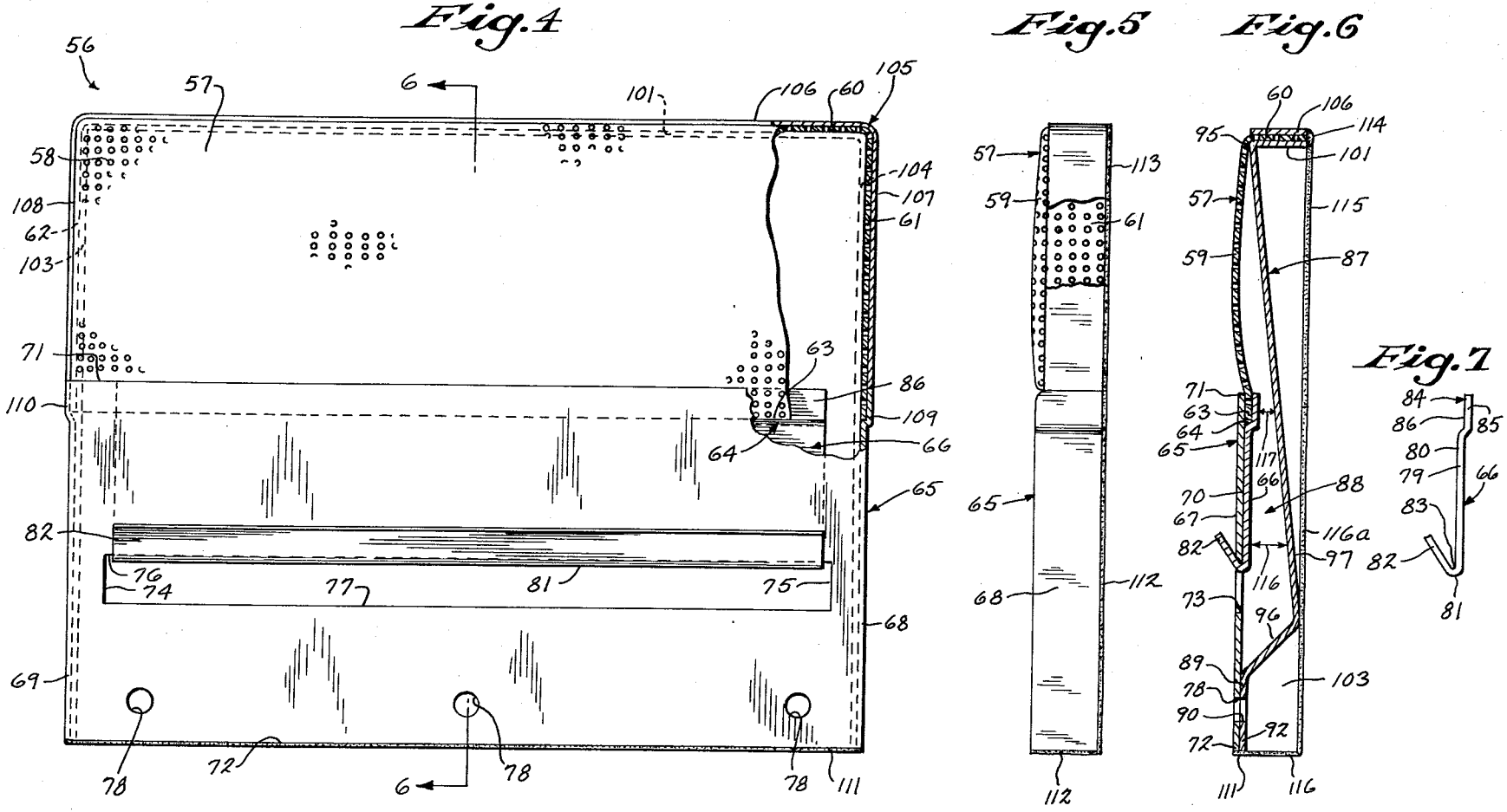
FIG. 4 is a front elevational view of one of the burner units of FIGS. 1–3.
FIG. 5 is a side elevational view of the burner unit of FIG. 4.
FIG. 6 is a sectional view along the line 6—6 in FIG. 4.
FIG. 7 is a side elevational view of a connector member employed in the burner unit of FIGS. 4–6.

The burner units 52 are similarly constructed and unit 56 is shown in detail in FIGS. 4 through 10. The burner unit 56 includes a specially designed perforated screen 57 containing a series of openings or holes 58 which permit the passage of air and combustible gas therethrough. It has been found that a screen made from 26 gauge steel and having 300 holes per square inch with each hole having a circular diameter of twenty-seven thousandths of an inch has performed very well by providing a passage constituting about 17 percent of the screen area. In addition, the screen 57 has been specially formed in a convex shape or configuration to provide a convex surface 59 which faces the chamber 23 when the burner sub-assembly 31 is interconnected with the heat exchanger sub-assembly 17. The screen 57 includes three outwardly extending perforated side walls 60, 61 and 62 which are nearly normal to the convex surface 59. A bottom portion of the screen 57 includes a lip 63 which is slidably journalled within a slot 64 formed between a front panel 65 and a connector member 66. The panel 65 includes a substantially rectangular outer front surface 67 and a pair of spaced side walls 68 and 69 which are formed normal to the surface 67. The panel 65 further includes a rear surface 70 oppositely disposed from the surface 67 while upper and lower edges 71 and 72 are located substantially within the same plane.

A generally rectangular slot 73 providing a pair of spaced side edges 74 and 75, an upper edge 76 and an oppositely spaced lower edge 77 is located near the center of the panel 65. A plurality of bolt or stud receiving openings 78 are located within the lower portion of the panel 65 between the edges 72 and 77.

The connector member 66 includes a main body portion 79 having an outer surface 80 engaging the surface 70 of panel 65 and further includes a lower end portion 81 forming an acute angle to provide a laterally extending lip 82 joined to the surface 80 by a bend 83. An outwardly extending end 84 is oppositely disposed from the end 81 and includes an offset portion 85 providing an offset surface 86 communicating with surface 80 with both surfaces 80 and 86 located in two substantially spaced planes.

The connector member 66 is joined to the panel 65 such as by spot welds or the like so that the lip 82 passes through the slot 73 and bend 83 engages the upper edge 76. As previously indicated, the surface 80 of the connector member 66 is fixedly connected to the surface 70 of the panel 65 so that the offset surface portion 86 is spaced from the surface 70 to provide the slot 64.

A backing member or panel 87 is connected to the screen 57 and to the panel 65 to provide a specially designed gas conducting channel 88. As clearly shown in FIGS. 8–10, the backing member 87 includes a lower panel portion 89 connected to the surface 70 of panel 65 and containing a plurality of stud receiving openings 90 aligned with the openings 78 while an edge portion 92 is aligned with edge 72. A pair of side edge portions 93 and 94 are oppositely spaced and substantially in the same plane as the edge portion 92 and an upper edge portion 95. The panel portion 89 and the edge portion 95 are also joined by V-shaped panel portions 96 and 97 which are separated by a bend 98. A side panel portion 99 is triangularly shaped and joins the panel portions 96 and 97 with the edge portion 93 while a side panel portion 100 is similarly shaped and joins the panel portions 96 and 97 to the edge portion 94. The back panel 87 also includes an outwardly extending flange portion 101 acutely extending from the panel portion 97 through a bend 102 located at the edge portion 95. In like manner, the edge portions 93 and 94 also include outwardly extending flange portions 103 and 104 which are substantially normal to and join the flange portion 101.

A U-shaped strip 105 includes a base portion 106 connected to the screen side wall 60 and a pair of leg portions 107 and 108 connected to the screen side walls 61 and 62, respectively. A pair of outer end portions 109 and 110 of the leg portions 107 and 108, respectively, engage and are welded to the side walls 68 and 69 of the panel 65.

The back panel 87 is secured to the front panel 65 and to the screen 57 through a continuous gas impervious weld. Specifically, the edge portion 72 of panel 65 is secured to the edge portion 92 of the backing member 87 by a continuous weld 111. The side edges of the flange portion 104 are secured to the side edges of the front panel side wall 68 by a continuous weld 112. The side edges of the flange portion 104, the screen wall 61 and leg portion 107 of the U-shaped member 105 are secured by a continuous weld 113. The side edges of the flange portion 101, the screen wall 60 and the base portion 106 of the U-shaped member 105 are secured by a continuous weld 114. The side edges of the flange portion 103, the screen wall 62 and the leg portion 108 of the U-shaped member 105 are secured by a continuous weld 115. Lastly, the side edges of the flange portion 103 and the side wall 69 of the front panel 65 are secured by a continuous weld 116*a*. In actual construction, the welds 111 through 115 form a single continuous weld which is impervious to the flow of gas. Such a weld provides a highly desirable gas conducting chamber 88 from which gas may only exit or enter through the opening 73 or the perforations 58 within the screen 57. The screen edge 63 which is movably retained by the slot 64 snugly engages the front panel 65 and the connector member 66 so that very little, if any, gas escapes from the channel 88 through the slot 64.

The burner units such as at 56 are thus specially constructed to supply pre-mixed combustible gas and air to the combustion zone located in the lower portion of chamber 23 generally located between the oppositely spaced burner units 55 and 56 for supplying heat energy to the fins 27 and copper tubing 24 provided by the heat exchanger 17 in a highly efficient manner. The channel 88 within the burner unit 56 thus is specially formed between the front panel 65, the connector 66, the screen 57, the back panel 88 and the U-shaped sealing member 105 to permit pre-mixed combustible gas and air supplied through the slot opening 73 to be channelled to the perforations or spaced openings 58 provided by the convex screen surface 59. It is particularly noted that the distance indicated at or near 116 between the connector member 66 and the panel portion 97 near the inlet opening 73 is substantially greater than the distance indicated at or near 116 between the same two members at a point near the exit opening to the combustion zone through the perforations 58. With such a construction, the cross-sectional area of the channel 88 at or near the inlet opening 73 is substantially greater than the cross-sectional area at or near the outlet perforations 58 which provides the desirous effect of increasing the gas velocity conducted therethrough. The specially formed cavity located behind the screen 57 has also been found to substantially reduce or eliminate sound producing resonance of the flame.

The burner unit 56 is removably connected to the base 34 with the lip 82 protruding through the slot 38 and making a sealing connection with an upper edge of the slot 38 formed within the side wall 36. Generally, bolts and associated locking nuts or other readily removably connecting studs are placed with the aligned openings 39, 78 and 90 to removably secure a burner unit such as at 56 to the base 34.

In operation, combustible gas and air are pre-mixed by the unit 41 with the gas valve 44 and the fan motor energized by electrical circuits at 45. Mixed gas and air is thereby supplied to the chamber 40 and to the slots 37 and 38 with the base 34 under a predetermined pressure established by the fan and mixing unit 41. The pre-mixed and pressurized gas and air is thus forced through the slots 37 and 38 into the plurality of channels 88 provided by the plurality of burner units 52 and to the plurality of associated convex shaped screens 56. When appropriate, the electronic control 45 provides a spark at the ignition electrode 46 to ignite the premixed gas and air at a location spaced a short distance from the perforated convex screen surface 59 within the combustion zone to provide a high energy flame within the lower portion of chamber 23 provided by the heat exchanger 17.

The diminishing cross-sectional area provided by the chamber 88 within each burner unit 52 substantially increases the gas velocity to provide a high velocity gas flow through the perforations 58 within the screen 57. Such increased flow velocity greatly decreases the possibility of flame flashback due to the possible failure of a screen because of hot spots or cracks and further reduces the possibility of flame resonance with the chamber 88 which might otherwise produce an undesirable high frequency sound.

The specially formed convex surface which is employed immediately adjacent to the flame in the combustion zone has been found to yield exceptional results in greatly reducing or eliminating buckling or wrinkling upon the screen surface and the resultant formation of cracks therein previously encountered in continued cyclic operation of firing and cooling the heating unit. It is also noted that screen 57 is fixedly held and sealed by welds on only three sides while a fourth side (edge 63) is permitted to expand and contract within the slot 64 formed between the panel 65 and the connecting member 66. Such variable movement of the screen edge 63 in response to changing temperature conditions is very desirable in preventing distortion of the screen surface 57 particularly during continuous cyclic operation.

The embodiment disclosed herein has disclosed the use of four burner units 52 spaced in a rectangular configuration to provide a highly compact combustion zone within the fire box. It is understood, however, that the burner units 52 could be placed in other geometric shapes and one alternative utilization employs a number of burner units arranged in a circular configuration.

The unit burners at 55 and 56 have been found to burn approximately 37,500 and 75,000 B.T.U. per hour respectively even though such units only stand less than 5 inches high. Ten such units have been spaced in a circular configuration to provide as much as 750,000 B.T.U. per hour of operation and higher in a highly compact configuration. The specially constructed burner units 52 thus provide a high energy device which has been found very desirable for use with heat exchangers functioning to supply heated fluids for commercial or residential uses.

Various modes of carrying out the invention are contemplated as being within the scope of the following claims particularly pointing out and distinctly claiming the subject matter which is regarded as the invention.

I claim:

1. A gas burning apparatus, comprising housing means providing a combustion zone burning combustible gas, a burner unit operatively connected to said housing means and including a unit housing providing a substantially impervious channel having a first cross-sectional area located adjacent an inlet opening and a second cross-sectional area less than said first area located adjacent an outlet opening containing a perforated screen having a convex surface extending across said outlet opening and facing said combustion zone with at least one side edge of said screen movably retained by said housing, and means supplying combustible gas and air at a predetermined pressure to said first area of said channel provided by said burner unit with said unit channel increasing the velocity of mixed combustible gas and air to provide a gas velocity at said combustion zone greater than the flame propagation and maintaining the flame within said combustion zone in spaced relationship to said convex surface.

2. The burning apparatus of claim 1, and including connector means removably connecting a plurality of said burner units to said housing means for defining said combustion zone and permitting the independent removal of a selected one of said plurality of units from said housing means.

3. The gas burning apparatus of claim 1, and including means intermittently supplying gas to said combustion zone through said perforated screen for intermittent burning within said combustion zone with the flame spaced from said convex surface.

4. The burning apparatus of claim 3, wherein said supplying means includes mixing means combining and supplying combustible gas and air at said predetermined pressure to said first area of said channel.

5. A gas burning apparatus, comprising housing means providing a combustion zone burning combustible gas and a supply channel providing a gas, a burner unit connected to said housing means and including a first front panel, a connector member connected to said first front panel and including a portion spaced from said first front panel and providing a recess therebetween, a second front panel including a perforated screen movably retained within said recess and providing a convex surface facing said combustion zone, a back panel connected to said first and second front panels to form a unit channel, and inlet means providing an opening communicating with said supply channel and said unit channel with gas flowing from said supply channel through said unit channel and said perforated screen to said combustion zone.

6. The burning apparatus of claim 5, wherein said back panel provides a first portion spaced from said first front panel by a first predetermined distance and a second portion spaced from said second front panel by a second predetermined distance less than said first distance with said unit channel increasing the velocity of said gas supplied therethrough.

7. The burning apparatus of claim 5, wherein said screen includes a first edge portion movably retained within said recess and a second edge portion fixedly connected with a gas impervious seal to said back panel.

8. The burning apparatus of claim 7, wherein said gas impervious seal includes a U-shaped member engaging said second edge portion and connected to said back panel by a weld.

9. A gas burning apparatus, comprising housing means providing a combustion zone burning combustible gas and a supply channel providing a gas, a burner unit connected to said housing means and including a first front panel, a connector member connected to said first front panel and including a first portion spaced from said first front panel and providing a recess therebetween and a second portion extending into said supply channel and providing a sealing connection with said housing means, a second front panel including a perforated screen movably retained within said recess, a back panel connected to said first and second front panels to form a unit channel, and inlet means providing an opening communicating with said supply channel and said unit channel with gas flowing from said supply channel through said unit channel and said perforated screen to said combustion zone.

10. The burning apparatus of claim 9, wherein said second portion of said connector member includes an outwardly extending lip passing through said inlet opening and into said supply channel.

11. A gas burning apparatus, comprising a liquid conducting system including a heat exchanger employing a liquid conduit having an inlet receiving cold liquid and an outlet supplying hot liquid, a mounting housing connected to said heat exchanger and providing a combustion chamber located adjacent to said heat exchanger and burning combustible gas and heating said heat exchanger and a mixing chamber located adjacent to said combustion chamber, a fan supplying predetermined amounts of combustible gas and air to said mixing chamber, and a plurality of spaced burner units removably connected to said mounting housing and conducting air and gas from said mixing chamber to said combustion chamber, each of said burner units including a burner housing providing a conducting channel having an inlet opening communicating with a corresponding opening into said mixing chamber and an outlet including a perforated screen having a convex surface facing said combustion chamber, said conducting channel having a first cross-sectional area located adjacent said inlet opening and a second cross-sectional area less than said first area located adjacent said screen and increasing the velocity of said air and gas being conducted through said screen from said fan through said mixing chamber and said conducting channel.

12. The burning apparatus of claim 11, wherein said burner housing includes a recess movably retaining a first side edge of said perforated screen and permitting thermal expansion and contraction of said screen.

13. The burning apparatus of claim 12, wherein said screen includes second, third and fourth side edges welded to said burner housing.

14. The burning apparatus of claim 11, wherein said burner housing includes an outwardly extending lip adjacent said inlet opening and providing a seal with a side edge of said mixing chamber opening.

* * * * *